US009504973B2

(12) United States Patent
Kisner et al.

(10) Patent No.: US 9,504,973 B2
(45) Date of Patent: Nov. 29, 2016

(54) EMAT ENHANCED DISPERSION OF PARTICLES IN LIQUID

(71) Applicant: UT-Battelle, LLC, Oak Ridge, TN (US)

(72) Inventors: Roger A. Kisner, Knoxville, TN (US); Orlando Rios, Knoxville, TN (US); Alexander M. Melin, Knoxville, TN (US); Gerard Michael Ludtka, Oak Ridge, TN (US); Gail Mackiewicz Ludtka, Oak Ridge, TN (US); John B. Wilgen, Oak Ridge, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 571 days.

(21) Appl. No.: 13/827,034

(22) Filed: Mar. 14, 2013

(65) Prior Publication Data

US 2014/0269151 A1 Sep. 18, 2014

(51) Int. Cl.

| | |
|---|---|
| ***B01F 11/02*** | (2006.01) |
| ***B01F 13/00*** | (2006.01) |
| ***B01F 3/12*** | (2006.01) |

(52) U.S. Cl.

CPC ..... *B01F 11/0291* (2013.01); *B01F 3/1242* (2013.01); *B01F 11/02* (2013.01); *B01F 11/0241* (2013.01); *B01F 13/0006* (2013.01)

(58) Field of Classification Search

CPC ..... B01F 11/0291

USPC ..... 366/108, 127, 273, 274

See application file for complete search history.

(56) References Cited

U.S. PATENT DOCUMENTS

| | | | | |
|---|---|---|---|---|
| 2,166,671 | A * | 7/1939 | Trofimov | C22B 4/00 366/273 |
| 3,219,318 | A * | 11/1965 | Hershler | B01F 13/0809 204/155 |
| 5,895,856 | A * | 4/1999 | Johnson | G01N 29/2412 73/643 |
| 7,534,980 | B2 | 5/2009 | Wilgen et al. | |
| 2006/0209628 | A1 * | 9/2006 | Jones | B01F 13/0818 366/273 |
| 2010/0019764 | A1 * | 1/2010 | Zahn | G01R 33/34046 324/309 |
| 2010/0259259 | A1 * | 10/2010 | Zahn | G01R 33/5601 324/309 |

OTHER PUBLICATIONS

"Improvement of Casting Speed and Billet Quality of Direct Chill Cast Aluminum Wrought Alloy with Combination of Slit Mold and Electromagnetic Coil", Materials Transactions, vol. 48, No. 8, pp. 2194-2201, dated 2007, The Japan Institute of Metals.

"Magnetic Field Processing—A Heat Free Heat Treating Method", Gerard M. Ludtka, Oak Ridge National Laboratory ORNL/TM-2012/78, pp. 1-62, dated Aug. 8, 2012.

* cited by examiner

*Primary Examiner* — David Sorkin

(74) *Attorney, Agent, or Firm* — Brinks Gilson & Lione

(57) ABSTRACT

Particulate matter is dispersed in a fluid material. A sample including a first material in a fluid state and second material comprising particulate matter are placed into a chamber. The second material is spatially dispersed in the first material utilizing EMAT force. The dispersion process continues until spatial distribution of the second material enables the sample to meet a specified criterion. The chamber and/or the sample is electrically conductive. The EMAT force is generated by placing the chamber coaxially within an induction coil driven by an applied alternating current and placing the chamber and induction coil coaxially within a high field magnetic. The EMAT force is coupled to the sample without physical contact to the sample or to the chamber, by another physical object. Batch and continuous processing are utilized. The chamber may be folded within the bore of the magnet. Acoustic force frequency and/or temperature may be controlled.

18 Claims, 8 Drawing Sheets

H: An alternating magnetic field induced by solenoid coil 110
J: An alternating circumferentially directed current induced by the H field
B: A static magnetic field induced by coils of the superconducting magnet 114
F: An alternating radially directed acoustic force induced by J x B and J x H where the magnitude of B >> the magnitude of H

H: An alternating magnetic field induced by solenoid coil 110
J: An alternating circumferentially directed current induced by the H field
B: A static magnetic field induced by coils of the superconducting magnet 114
F: An alternating radially directed acoustic force induced by J x B and J x H where the magnitude of B >> the magnitude of H

EMAT ENHANCED DISPERSION OF PARTICLES IN LIQUID

STATEMENT REGARDING FEDERALLY FUNDED RESEARCH AND DEVELOPMENT

This invention was made with government support under Contract No. DE-AC05-00OR22725 between UT-Battelle, LLC. and the U.S. Department of Energy. The government has certain rights in the invention.

BACKGROUND OF THE INVENTION

1. Technical Field

This invention relates to dispersion of particulate matter in a host material, and more particularly, to systems with electromagnetic acoustic transduction (EMAT) enhanced dispersion of particles in liquid.

2. Related Art

Commercially available acoustic processing systems may involve direct contact with a melt, resulting in undesirable chemical interactions when an acoustic probe or horn is inserted directly into the molten material or in direct contact with a containment vessel such as a crucible or mold. Acoustic transducers may be limited in temperature range, and therefore may need to be thermally isolated from high-temperature environments through the use of an acoustical waveguide, or horn. Acoustic impedance mismatches between the transducer and the waveguide, as well as between the waveguide and the melt may limit the transfer of energy. Various types of probe coatings have been investigated in an effort to minimize the chemical interactions of the probe surface with the melt. In addition, the localized nature of a horn probe may result in a non-uniform distribution of acoustical energy within the melt crucible.

SUMMARY

Particulate matter may be dispersed in a fluid material. A sample including a first material in a fluid state and a second material comprising particulate matter may be placed into a chamber. One or both of the first material and the second material may comprise a single substance or a plurality of substances. The second material may be spatially dispersed in at least a portion of the first material utilizing an electromagnetic acoustic transduction force. The dispersion process may continue until a spatial distribution of the second material in the first material enables a quality of the sample to meet a specified criterion.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

In some systems, mechanical stirring may be utilized to mix a powder into a liquid medium. However, dispersion of particulate matter in a liquid may be performed or enhanced by the application of sonic or ultrasonic energy. One method of applying acoustic energy that may be effective in mixing conductive and non-conductive materials includes electromagnetic acoustic transduction (EMAT). The mixing effect may come from a force F generated as a result of an electric current passing at right angles to a magnetic field:

$$F=JxB, \tag{1}$$

where F is a vector force on a current carrying object, J is a current density vector, B is a magnetic field vector and x is a vector cross product. For systems that employ large magnetic fields, for example, of 8 to 16 Tesla, the force may be quite large.

EMAT forces may enable dispersion of particulate matter in a liquid without physical contact to the affected sample. For nonconductive materials such as lipids or low salt aqueous solutions, a conductive chamber or susceptor in which the J currents may be induced may be used to hold the material. The high acoustic forces generated by the J currents in the susceptor may be coupled to the nonconductive material within the susceptor. Additional information regarding generation of acoustic forces may be found in U.S. Pat. No. 7,534,980, which was filed Mar. 30, 2006 and is incorporated herein by reference in its entirety. Applying acoustic power to the sample and heating or cooling of the sample may be balanced so as to produce a final product with desired properties while maintaining efficient power consumption.

Figure 1:
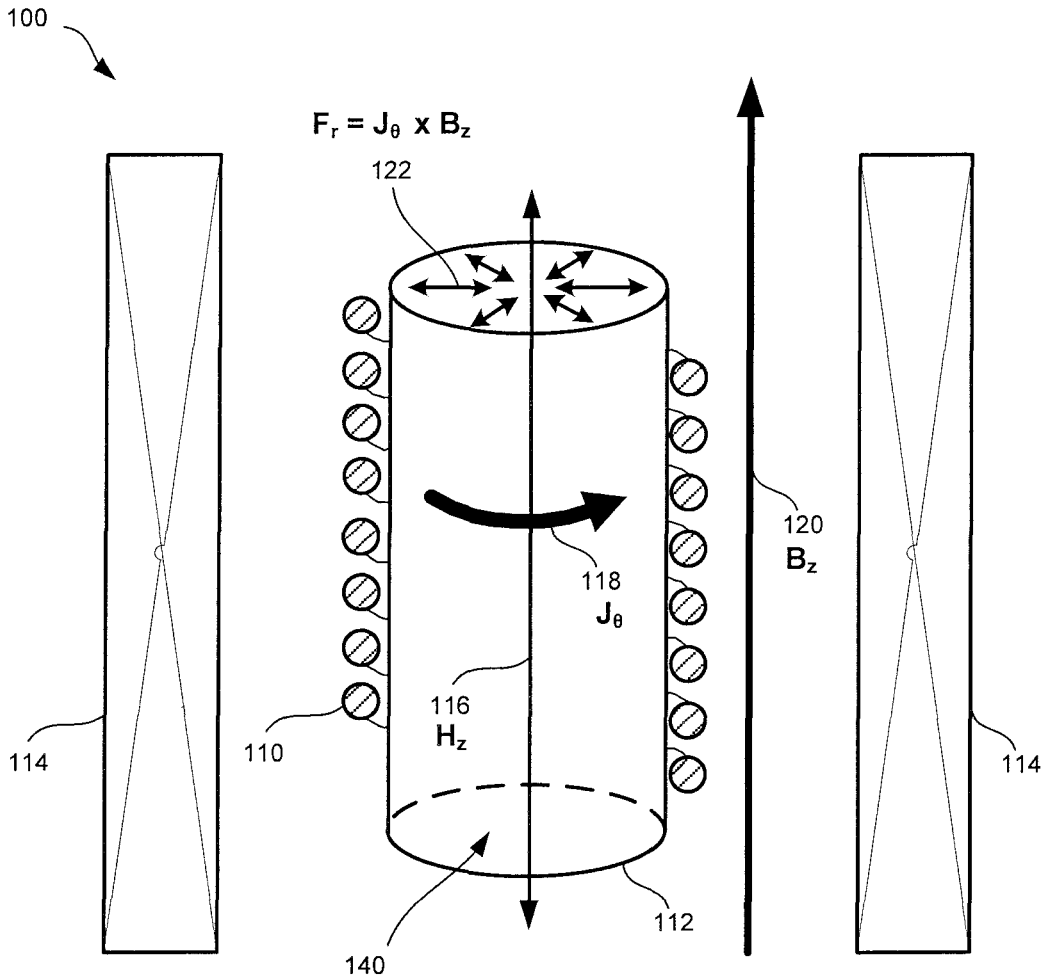
FIG. 1 illustrates a partial sectional view of an electromagnetic acoustic transducer by which Lorentz forces may be utilized to disperse particulate matter within a fluid material held in a chamber by exerting an oscillatory acoustic pressure on the chamber and/or its contents.

FIG. 1 illustrates an electromagnetic acoustic transducer by which Lorentz forces may be utilized to disperse particulate matter within a fluid material held in a chamber by exerting an oscillatory acoustic pressure on the chamber and/or its contents. Referring to FIG. 1, there is shown a system 100 including a chamber 112, a primary coil 110 and a secondary coil 114.

The chamber 112 may have a cylindrical shape and may be made of a conductive material, for example, copper or silver. However, the chamber is not limited in this regard and any suitable shape, size or material may be utilized. The chamber 112 may be a sealed container or may have openings that enable a material to flow through it (shown in FIGS. 2 and 3). The chamber 112 may hold a sample 140 including a fluid base material. The base material may be electrically conductive or insulating. In some instances when the base material is electrically conductive, the chamber 112 may be non-conductive. For example, a conductive base material may be held in a non-conductive ceramic vessel or a conductive vessel. Alternatively, a non-conductive base material may be held in a conductive vessel. The chamber 112 may be referred to as a vessel, a crucible, a mold or a susceptor for example.

The base material may comprise any suitable material or plurality of materials, which may be capable of flowing, may yield to pressure or may have constituent parts that may change position relative to each other. The base material may be referred to as a liquid, a fluid or a melt, for example. However, the base material is not limited in this regard. In some systems, the base material may comprise a semi-solid or slushy material which may include liquid plus solid material, for example. The base material may comprise a single substance or may include a plurality of substances. Base materials may comprise, for example, lipids, aqueous solutions or molten materials such as metals. However, the system is not limited to any specific base materials and any suitable base material or materials may be utilized. The viscosity of the base material may affect operating parameters of the system 100. The base material in the chamber 112 may be heated and/or cooled during processing. In some systems, the base material in the chamber 112 may be formed by a state change from a solid, liquid or gas inside of the chamber. The chamber 112 may also comprise particulate matter or particulate matter may be added to the liquid in the chamber. The particulate matter may comprise a single substance or a plurality of substances. For example, the particulate matter may comprise a first dispersoid that may be utilized to enhance thermophysical properties of the dispersion process while another dispersoid may be utilized to enhance mechanical properties of the dispersion process. Particle populations of one or more morphologies and/or one or more particle distributions may be chosen for the sample in order to enhance materials performance, for example, depending on a particular application or a desired end product. The particulate matter may be referred to as a material, a dispersoid, a dispersant, a population distribution, particles, powder or a doping agent, for example. The particles may be of any suitable dimension or composition. For example, the dimensions of a particle may be on the order of a molecule or may be on the order of ten microns. The particles may be chemically inert or weakly reactive in the media. In some systems, small particle dimensions of the order of less than 100 nm may be more difficult to disperse than micron-sized particles. The importance of EMAT mixing, therefore, may be greater for dispersing the smaller particles; however, the system is not limited in this regard. The system 100 may be operable to perform EMAT enhanced dispersion where the particles remain intact. For example, the particles may become uniformly distributed throughout the base material. The system 100 may also be operable to perform EMAT enhanced dissolution where the particles may go into solution. For example, the particles may no longer exist as particles but may become part of a solution. Furthermore, EMAT processing may cause some materials to go into solution that otherwise would not do so. In this regard, the acoustic energy of the system 100 may be sufficient to overcome energy thresholds that limit solubility. An example may be graphite nodules in cast iron. The ratio of particles to liquid and/or the nature of particles in the sample 140 may vary depending on various factors including, for example, properties of materials being mixed together and/or desired properties of an end product. Moreover, the particles may comprise one or more substances.

The system 100 may be operable to utilize electromagnetic acoustic transduction forces to disperse the particulate matter in the liquid held in the chamber 112 such that a desired spatial distribution and/or concentration of the particulate matter may be reached. Rheological properties of the liquid may affect how the system 100 may be configured for operation. In some systems, additional agents may be added to the liquid and particulate matter in the chamber 112 that may affect the way materials in the chamber combine. In some systems, the EMAT forces may enable a chemical change in the mixed product. Evaluation of the product mixture may be based on rheological analysis and/or differential scanning calorimetry to determine whether the system 100 produces a desired result. The resulting mixture of liquid and dispersed particles may be cooled or heated and may be transformed to a solid or gas phase, for example.

The chamber 112 may be placed within the primary coil 110 which may be referred to as the induction coil. An alternating current flowing in the primary coil 110 may induce a magnetic H-field 116 consistent with the boundary condition $H_{tan}$ is proportional to $J_{coil}$ where $J_{coil}$ is the current density in the primary coil 110. When a conductive object, for example, the chamber 112 and/or the liquid and particulate matter within the chamber, is placed within the induction coil 110, the axially directed components of the magnetic H field 116 may induce a circumferentially directed current $J_\theta$ 118 on the surface of the conductive object. To a first order approximation, the current density induced on the object may be equal to the current density of the induction coil 110, $J_{coil}$. The depth to which the induced current $J_\theta$ 118 penetrates the conductive object may be determined by the classical skin depth. The induced current may cause induction heating in the object. For example, an electrically conductive surface of the chamber 112 and/or an electrically conductive surface of the liquid and particulate matter sample 140 within the chamber 112, may be heated by the induced current $J_\theta$ 118. The sample 140 including the liquid base material and particulate matter may be referred to simply as the sample 140.

As the surface $J_\theta$ current 118, flows perpendicularly to the axial magnetic field Hz 116, a force or pressure 122 may act on the surface of the chamber 112 and/or the sample 140 inside the chamber and may be directed inward, in the radial direction (in cylindrical coordinates). Because the surface $J_\theta$ current 118 may change polarity when the H-field 116 changes polarity, the resulting force $F_r$ 122 may oscillate, in and out, in the radial direction. If a magnetic field is defined as $B_z=\mu_0 H_z$, the magnitude of the pressure on the chamber 112 and/or the sample 140 may be given by $F_r=J_\theta \times B_z$. This is essentially an electromagnetic acoustical transducer (EMAT), and in some systems, this rather weak effect may be utilized for an induction heating process.

The chamber 112 and the primary coil 110 may be situated coaxially in the interior of a secondary coil 114. The secondary coil 114 may produce a high energy static magnetic $B_z$ field 120 relative to the weaker alternating H field 116. The term high magnetic field may refer to a magnetic field strength of about one Tesla or greater. The secondary coil 114 may comprise a greater number of turns than the primary coil 110. In some instances, the secondary coil 114 may comprise a superconducting magnet that may persist after an initial current is established, without additional power supplied to its coil. However, the system is not limited with regard to any specific type or strength of magnet or to how the magnets are powered, and any suitable methods may be utilized. When the induction $J_\theta$ current 118 is applied in the high magnetic field environment and the static magnetic B field 120 is aligned with the axis of the induction coil 110, then the magnitude of the electromagnetic field and the resulting EMAT force may be greatly enhanced.

In instances when the axis of the induction heating coil 110 is aligned with the axis of the static magnetic field 120 of the high-field magnet 114, the circumferentially directed induced alternating surface current $J_\theta$ 118 may interact with the axial component of the static $B_z$ field 120 enhancing the radial $F_r$ force 122. The result may be a large oscillatory electromagnetic force, or pressure at the frequency of the induction $J_\theta$ current, 118 that may act directly on the chamber 112 and/or the liquid and particulate matter held in the chamber 112. In cylindrical coordinates, the force may be in the radial direction. The system is not limited with regard to the frequency at which the $F_r$ force 112 oscillates. The frequency of the alternating $J_\theta$ current 118 and/or the alternating radial $F_r$ force 122 may oscillate at any suitable frequency or any suitable plurality of frequencies when processing the liquid and particulate matter utilizing EMAT forces. The frequency may be referred to as the mixing frequency. In some systems, the frequency may be in a sonic or ultrasonic range, for example, mixing may occur at frequencies below 10 Hz to frequencies greater than 1000 kHz.

FIG. 1 illustrates an induced alternating current system in a high-field magnet 120, including the alternating H-field 116 of the induction coil 110, the induced circumferentially directed surface $J_\theta$ current 118, the static magnetic $B_z$ field 120 and the resulting electromagnetic $F_r$ force 122. The axial component of the H-field 116 may be insignificant in magnitude by comparison with axial component of the large static $B_z$ field 120 of the high-field magnet 114 ($\mu_0 H_z$ 116$\ll B_z$ 120). The magnitude of the pressure on the conductive sample 140 may be represented as a radial force $F_r = J_\theta \times B_z$, where $B_z$ is the axial component of the static magnetic field 120. It is important to understand that the acoustic driving force 122 may be bi-directional, alternately compressing and stretching (tensioning) the sample 140 and/or the chamber 112. The acoustic pressure $F_r$ 122 may be quite substantial since the cross product of the induced surface current $J_\theta$ 118 and the static magnetic $B_z$ field 120 may be very large. The high-field magnet 114 may greatly enhance acoustic stimulation of the sample 140 in the chamber 112 and the force 122 may alternate at a frequency that is equal to the induction $J_\theta$ current 118 frequency. In some systems, the use of a super conducting magnet for the high field magnet 114, may greatly reduce energy consumption of the EMAT (electromagnetic acoustical transducer) system 100.

The process of dispersing particulate matter in a liquid within the chamber 112 may be improved when the acoustical excitation frequency of $F_r$ 122 coincides with a natural resonant frequency of the chamber 112 and/or the liquid and particulate matter sample 140 which may form an acoustical resonator. If the acoustic drive frequency $F_r$ is chosen to match a natural resonant frequency of the sample 140 and/or the chamber 112, then the peak acoustic pressure in the resonator may be enhanced by a factor that is equal to the quality factor of the resonator. Quality factors for liquid metal columns with large length-to-diameter ratios may be in the range of 10-100, for example. However a somewhat smaller quality factor might be anticipated in many system configurations.

In some systems, the primary coil 110 and/or the secondary coil 114 may include a varied coil spacing in order to promote improved stirring effects in the liquid or semi-solid sample. In this regard, the coil windings may be closer together or more dense along some portions of the length of the sample and further apart or less dense along other portions of the length of the sample. In places where the number of turns per unit length varies, magnetic field gradients may occur and the strength of the radial force $F_r$ 122 will vary along the z axis relative to the gradients. Spacing of the windings in the primary coil 110 and/or in the secondary coil 114 may be chosen so as to vary the magnitude of radial force $F_r$ 122 at different positions along the z axis and thus induce a variety of EMAT stirring effects. The gradients may promote shearing or eddies in the sample that may help break-up particle agglomerations or facilitate particle wetting in the sample. The system is not limited with regard to any specific coil spacing and any suitable spacing may be utilized, including a uniform spacing.

In some systems, the primary coil 110 and the secondary coil 114 may be nested in reverse order where the chamber 112 is placed inside of the secondary coil 114 and the primary coil is placed external to the chamber 112 and the secondary coil 114. Moreover, in some systems, the secondary coil 114 may generate an alternating magnetic field rather than a static magnetic field.

In operation the system 100 may utilize an electromagnetic acoustic transduction force F 122 to mix particulate matter within a liquid medium. The system 100 may produce an end product with rheological properties or other physical properties which may be consistent with a desired level of dispersion or a pattern of dispersion of the particulate matter in the liquid. For example, the end product may be a type of food with a desired texture and flavor. Alternatively, the end product may be an electrically conductive material with a specified conductivity. In some systems, EMAT force processing may be enhanced with additional processing methods or pre-processing methods, for example, to introduce particulates into a melt material, or to distribute particulates uniformly throughout the entire volume. In some cases an EMAT dispersion process step may be more effective if the particulates are initially introduced and blended in a pre-processing step. The pre-processing step may serve to overcome surface tension of the liquid and to partially separate particles clustered together due to van der Waals forces, for example. This processing or pre-processing step might involve mechanical shear stirring, non-contact magnetohydrodynamic (MHD) stirring utilizing an induction coil, or a separate ultrasonic mixing process, for example. In some systems, this initial step may result in the production of a "master alloy," a "base metal" or a "base material" with a certain concentration of particulates that can later be used to deliver a number of particulates into a subsequent process melt. After adding the master alloy or base material to a process melt, the highly concentrated particles may be distributed throughout the volume via a stirring process, possibly utilizing non-contact induction stirring. In this manner a more or less uniform particle concentration may occur throughout the melt, for example, at a macroscopic level. After a specified condition has been accomplished, a more efficient and effective EMAT dispersion process step may be applied to disperse the particles, for example, at a nanoscale level in the subsequent process melt. In some systems, other stirring processes may enable shorter EMAT processing times. However, the system is not limited in this regard, and a pre-processing step or additional processing step may not be utilized in some EMAT systems.

Figure 2:
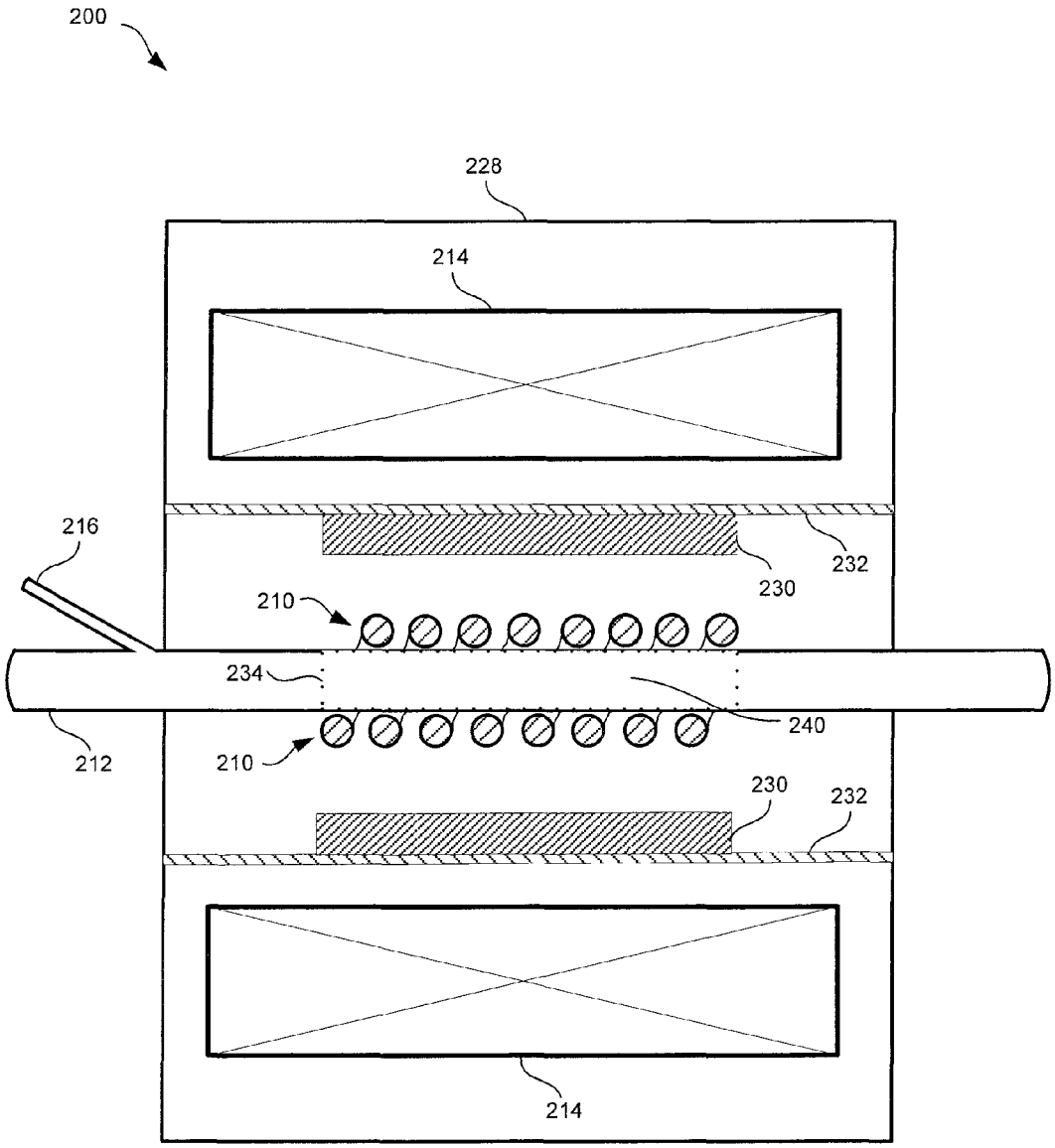
FIG. 2 illustrates a partial sectional view of a continuous process for electromagnetic acoustic transduction enhanced particle dispersion.

FIG. 2 illustrates a partial sectional view of a continuous process for electromagnetic acoustic transduction enhanced particle dispersion. FIG. 2 comprises a system 200 which includes a cryogenic system 228 surrounding a super conducting magnet 214. The cryogenic system 228 may comprise a fluid cooling bath such as liquid helium, for example. Also shown in FIG. 2 are a chamber 212, a particulate matter inlet 216, a primary induction coil 210, an electromagnetic acoustic transduction (EMAT) zone 234 and a sample 240 including liquid and particulate matter. In some systems an actively cooled conductive lining 232 may be placed between the primary induction coil 210 and the bore of the cryostat to prevent heat loading of the cryogenic system 228 and quenching of the superconducting magnet 214.

The induction coil 210, chamber 212, high field magnet 214 and sample 240 may be similar or substantially the same as the induction coil 110, chamber 112, high filed magnet 114 and the sample 140 described with respect to FIG. 1. The coil 210 may be wrapped around the chamber 212. $J_\theta$ currents 118 may be induced in the chamber 212 and/or in a susceptor of the chamber 212 by the primary induction coil 210 and the superconducting magnet 214. $F_r=J_\theta \times B_Z$. Alternating acoustic forces may be generated radially into and/or out of the chamber 212 at the EMAT zone 234, as described with respect to FIG. 1. In some systems, ceramic spacers 230 may support the induction coil 210 against electromagnetic forces. In some systems, the chamber 212 may be electrically and/or thermally insulated from the induction coil 210.

The chamber 212 may comprise a cylindrical shape and may be operable to pass a liquid or flowing material from an input to an output. The chamber 212 may be made of one or more materials that may be chosen based on electrical and/or thermal properties such that acoustic force and/or heat transferred to the material flowing through the chamber 212 may be controlled. Particulate matter may be added to a base material flow before it enters the chamber 212 or while it is streaming through the chamber 212 via the particulate matter inlet 216. For example, the chamber 212 may have a means, such as a hopper or valve controlled manifold, for adding one or more substances to the base material stream. As the base material and particulate matter flow through the EMAT zone 234, the particulate matter may be mixed into the base material by the radial forces $F_r$ 122 described with respect to FIG. 1. In some systems the base material and particulate matter may be mechanically stirred or combined before and/or after flowing through the EMAT zone 234.

In one example, $F_r=J_\theta \times B_z$ EMAT forces may be generated by the primary and secondary coils 210 and 214 and may be applied to mix a powder into a lipid material in the EMAT zone 234. The powder may be injected in the liquid stream as it flows through the chamber 212. The mixture may flow to the EMAT zone 234 where high acoustic pressure may cause agitation of the sample 240 and in some systems, cavitation. A dispersed mixture may then exit the EMAT zone 234. The chamber or susceptor 212 may be heated as a result of resistive dissipation of the $J_\theta$ currents due to $I^2R$ in the chamber 212. In this manner, heat may be added to the liquid from the susceptor. Acoustic power and heating may be balanced so as to produce a desired final product and reduce power consumption.

Table 1 and Table 2 comprise an example of a set of engineering input parameters and a set of determined or calculated parameters that may be considered with regard to energy consumption and effectiveness in the system 200. The determined parameters may indicate that a choice of input parameters, for example, inlet temperature, mass flow, heat capacity, induction current, induction coil length, susceptor diameter, susceptor resistance, magnet field strength and magnet power or other physical parameters, may affect the resulting mixture in terms of, for example, dissipated power, acoustic energy available for particle dispersion, and outlet temperature. Process efficiency may also be a product of operating parameters.

TABLE 1

| Input Operating Parameters | | | | | | | | |
|---|---|---|---|---|---|---|---|---|
| Inlet Temp ° C. | Mass Flow kg/s | Heat Capacity J/(g · K) | Induction Current Amperes | Susceptor (Coil) Length Meter | Susceptor Diameter Meter | Susceptor Resistance Ohms | Field Strength Tesla | Magnet Power W |
| 28 | 0.4 | 1.5 | 2800 | 0.1 | 0.03 | 0.0015 | 9 | 1500 |
| 28 | 0.02 | 1.5 | 600 | 0.1 | 0.03 | 0.0015 | 11 | 1500 |

TABLE 2

| Determined or Calculated Parameters | | | | | | | |
|---|---|---|---|---|---|---|---|
| Heating Power W | Acoustic Pressure N/m^2 | Acoustic Power W | Parasitic Losses W | Total Induction Power W | ΔT ° C. | Outlet Temperature ° C. | Power Ratio W · hr/kg |
| 11760 | 252000 | 399.01 | 1176 | 13335.01 | 19.60 | 47.60 | 10.30 |
| 540 | 66000 | 27.37 | 54 | 621.37 | 18.00 | 46.00 | 29.46 |

Calculated entries in Table 2 may be derived from the following equations. Constants for water are assumed.

Total Induction Power:

$$Q_{Induction}=Q_{Heating}+Q_{Acoustic}+Q_{Parasitic} \quad (2)$$

where the total power from induction current is the linear sum of heating energy in the susceptor, acoustic energy deposited, and parasitic losses.

Heating Power:

$$Q_{Induction}=i^2R_{Susceptor} \quad (3)$$

where i is the total induction current and R is the susceptor or chamber equivalent resistance in the case of an electrically conductive chamber.

Acoustic Power:

$$Q_{Acoustic}=p^2/Z, \quad (4)$$

where p is the acoustic pressure and Z is the acoustic impedance and the impedance of water is assumed.

Mass Heat Flow:

$$Q_{Heating}=\dot{m}Cp\Delta T, \quad (5)$$

where $\dot{m}$ is the liquid mass flow, Cp is the heat capacity, and ΔT is the temperature difference.

Total System Power:

$$Q_{Total}=Q_{Induction}+Q_{Magnet}, \quad (6)$$

where $Q_{Magnet}$ is the power used by the cryo-cooler to reduce liquid helium consumption.

In some systems, heat removed from the liquid helium may be used to heat process water, further improving efficiency of the EMAT mixing process. At higher flow rate and corresponding higher induction power, this improvement may be minimal, but at low flow rates with low power induction, reclaiming the waste heat may have a larger effect on system efficiency.

A comparison of the determined power ratio may made to typically measured values of 50 to 100 W·hr/kg for mechanical mixing systems. For the two cases represented in Table 2, the calculated values are within about a factor of two.

Figure 3:
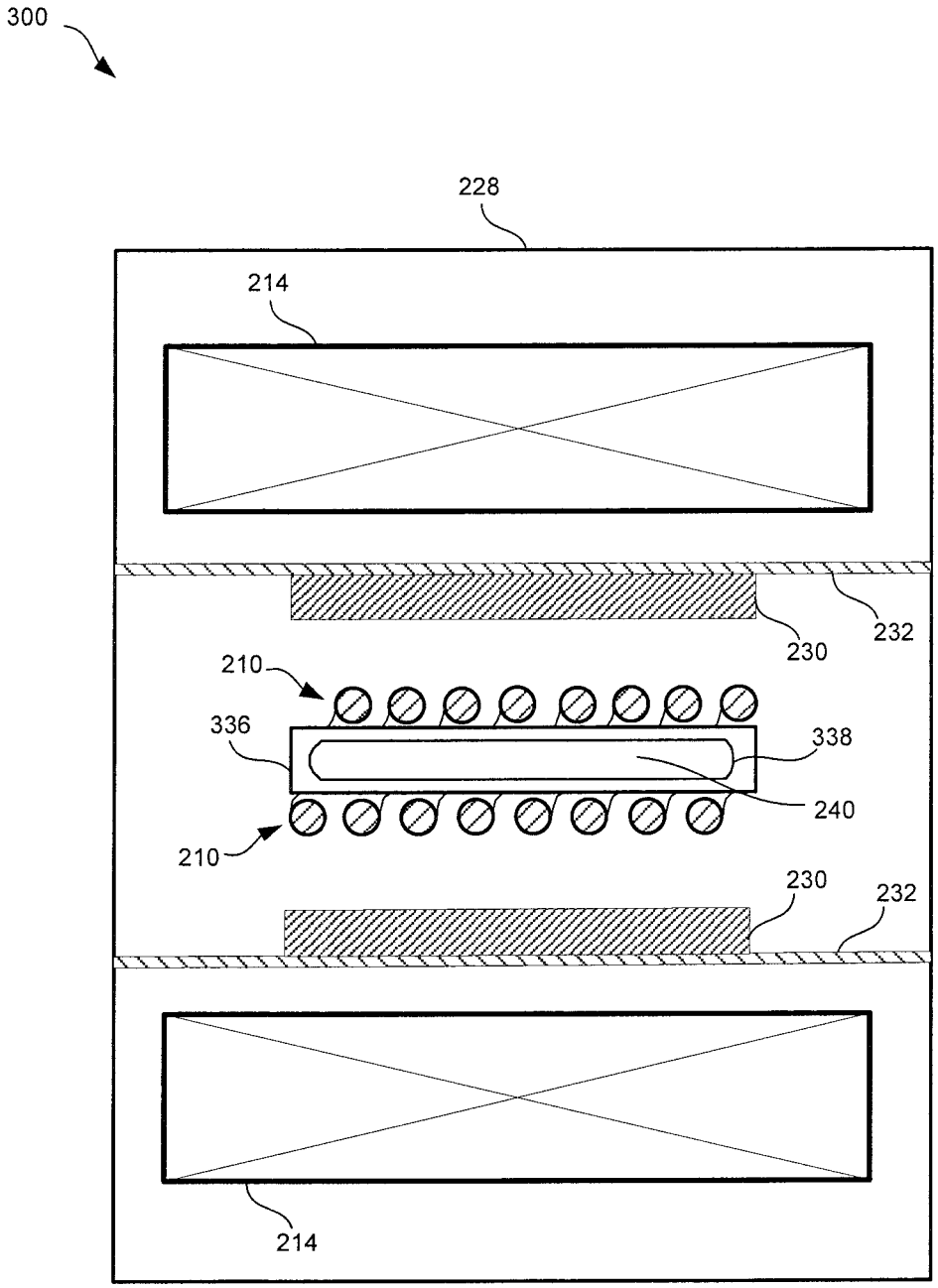
FIG. 3 illustrates a partial sectional view of a batch process system for enhanced electromagnetic acoustic transduction dispersion of particles in a liquid.

FIG. 3 illustrates a partial sectional view of a batch process system for enhanced electromagnetic acoustic transduction dispersion of particles in a liquid. The cryogenic system 228, super conducting magnet 214, primary induction coil 210, actively cooled conductive lining 232, ceramic spacers 230 and sample 240 are described with respect to FIGS. 1 and 2.

In FIG. 3, a chamber 338 may be similar to the chamber 112 and may hold or seal a liquid base material and particulate matter sample 240 that is to be mixed using EMAT forces. In some instances, a gas space may be included in the chamber 338 to allow for thermal expansion. The chamber 338 may be utilized rather than flow through chamber 212 as described with respect to FIG. 2, for batch processing rather than continuous processing. In some systems, the chamber 338 may be made of copper and may act as a susceptor that may carry a circumferentially directed induced current J. Because copper may be very electrically conductive, heating may be minimized in a chamber made of copper or silver, for example. However, even though heating of the liquid mixture may be low or even cooled, the frequency of the induction current on the chamber 338, or mixing frequency, may generate EMAT acoustic vibrations that may couple to and/or agitate the materials internal to the chamber 338. In some systems, the chamber 338 may be cooled or heated by a cooling or heating jacket 336.

Typical mixing frequencies may range from below 10 kHz to over 100 kHz. In some systems multiple frequencies may be utilized. The frequencies may be applied in sequence, simultaneously or may be swept. Lower frequencies may be more effective in causing extreme pressures and cavitation. However, the same forces may be imposed on the induction coil and/or susceptor which may result in work hardening and metal fatigue. Higher frequencies may impart shorter particle displacement for equal magnitudes of force. Engineering calculations may be utilized to determine how high or low an applied frequency should be and what intensity may be utilized before destruction of the induction coil and/or susceptor.

Figure 4:
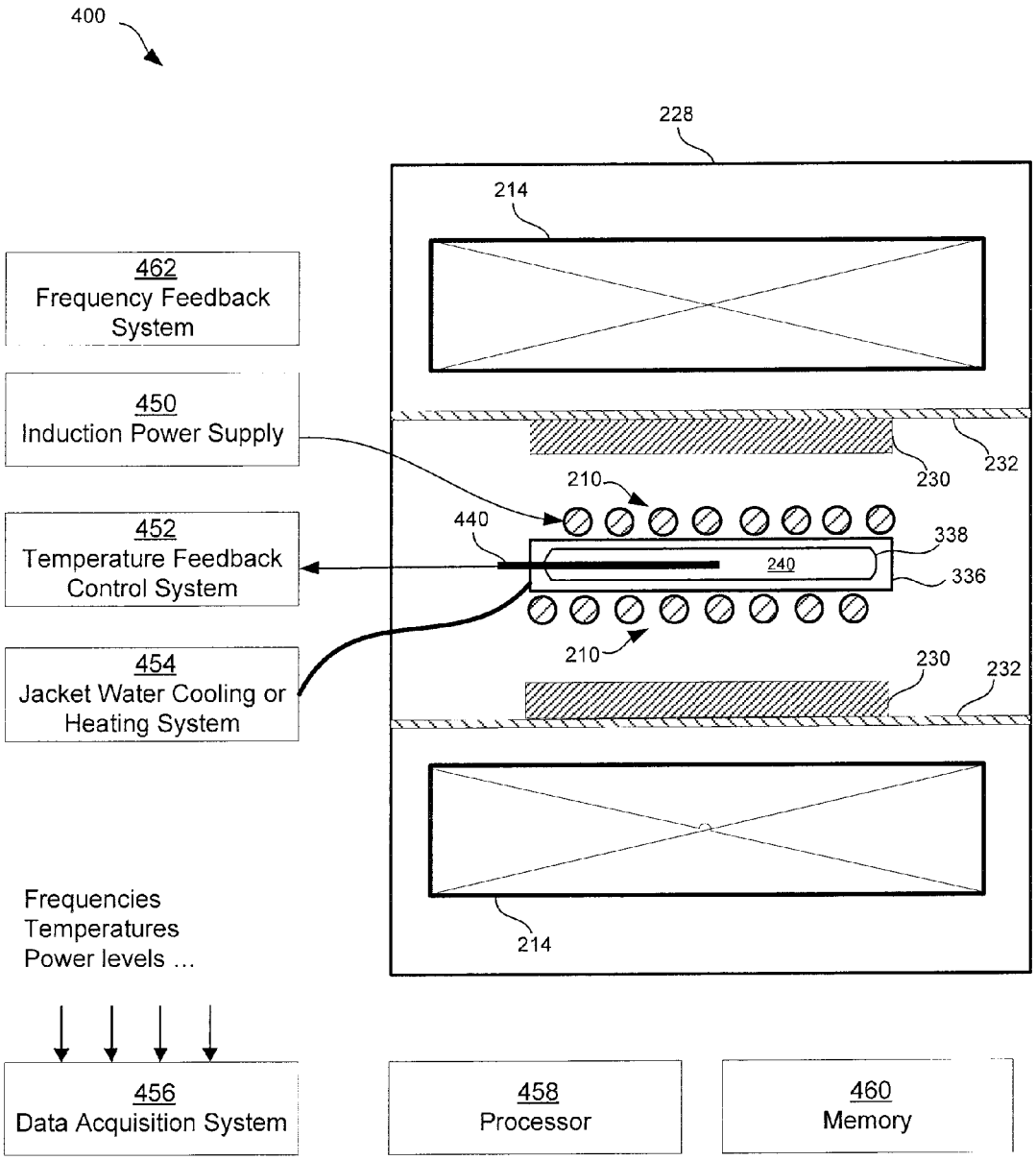
FIG. 4 illustrates a partial sectional view of a diagram of an exemplary electromagnetic acoustic transduction batch mixing system including an induction power supply, temperature control and data acquisition.

FIG. 4 illustrates a partial sectional view of a diagram of an exemplary electromagnetic acoustic transduction batch mixing system including an induction power supply, temperature control and data acquisition. The system 400 may include the cryogenic system 228, super conducting magnet 214, primary induction coil 210, actively cooled conductive lining 232 ceramic spacers 230, sample 240, batch chamber 338 and cooling jacket 336 which are described with respect to FIGS. 1, 2 and 3.

The system 400 may comprise one or more components that may enable control of the EMAT mixing process. For example, one or more of an alternating power supply 450, a frequency feedback system 462, a temperature sensor 440, a temperature feedback system 452, a jacket cooling or heating system 454, a data acquisition system 456, one or more processors 458 and memory 460 may be used to monitor and/or control EMAT mixing processes of the sample 240 within the batch chamber 338.

A temperature sensor 440 may be utilized to measure temperatures in the chamber 338 and/or temperatures in the sample 240 materials being mixed within the chamber. In some systems, the temperature sensor 440 may be a type T thermocouple. The temperature feedback system 452 may read temperatures from the temperature sensor 440. The feedback may be utilized to control various operating parameters in the system that may control the temperature in the chamber 338. For example, the sensed temperature may be utilized by the jacket cooling or heating system 454 to adjust temperature of the cooling or heating jacket 336. The cooling or heating jacket 336 may exchange water with the cooling or heating system 454 to control sample material 240 temperatures in the chamber 338. The temperatures may be controlled to improve the EMAT mixing process and/or to reduce heat related, damaging effects to components in the system 400. In addition, the induction current in the coil 210 may be adjusted by the induction power supply 450 to increase or decrease heating in the chamber or susceptor 338 based on the sensed temperature.

The induction coil 210 and/or power supply system 450 may be tuned to a fixed frequency depending on process parameters or may be tunable to operate a various frequencies. Some systems may comprise the frequency feedback control 462. Frequencies in the induction coil 210 may be configured based on resonance information provided to the feedback control system 462. The induction current frequencies may be controlled to track shifts in resonance of the chamber 338 and/or materials within the chamber that may occur due to thermal effects or mechanical changes.

In some systems, the electrical resonance of the induction coil 210 and acoustic resonance of the chamber 338 with enclosed sample materials 240, may not share the same frequencies. In this situation, the tunable induction power supply 450 may be operable to generate a modulated carrier waveform that may be used to apply two frequencies simultaneously to the induction coil 210. For example, the carrier wave form may correspond to the electrical resonance of the induction coil 210 and the modulation frequency may correspond to the resonance of the chamber and internal sample materials 240. In this manner, mixing of the liquid and particles in the chamber 338 by electromagnetic acoustic transduction may be improved. In cases where the resonance frequency of the induction coil 210 system is not at a frequency desirable for a particular level of mixing, it may be possible to introduce a lower frequency into the system by amplitude modulation of a carrier. In this regard, the resonant frequency of the induction coil 210 system may include the resonant frequency of the induction coil 210 and its associated capacitance. For example, in a particular system, an induction coil 210 resonance of 300 kHz may be too high to effect sufficient EMAT-induced molecular motion and a desired level of dispersion may not occur. However, by pulsing the 300 kHz drive at the acoustic-mechanical resonance of the mixing chamber 338, energy may be diverted into a lower sonic energy, for example, 5 kHz that may accomplish the function of EMAT mixing. In this manner, the EMAT mixing method may be improved by increasing the degrees of freedom for a system designer to choose alternative combinations of coil sizes and mixing chambers. Such combinations may lower the cost of a system. Furthermore, in instances when clumps of particulates occur after an introduction of particulates into a melt, for example, due to various physical and/or chemical attraction forces such as Van der Waals forces and/or liquid surface tension, certain frequencies and/or power levels may be chosen to break-up the clumps and disperse the individual particles. For example, in some systems low EMAT frequencies such as 10 Hz to 1000 Hz may be effective in an initial stirring of the materials.

The system 400 may comprise the processor 458 and memory 460. The processor 458 may be operable to execute instructions stored in the memory 460 to automate temperature control, frequency control and/or power control in the system 400. For example, the processor 458 and/or the memory 460 may be communicatively coupled to one or more of the induction power supply 450, the frequency feedback control system 462, the temperature feedback control system 452 and/or the jacket cooling system 454, and may provide control information to improve EMAT mixing in the chamber 338 and/or improve operating conditions for components in the system 400.

The data acquisition system 456 may be communicatively coupled to one or more sensors or feedback mechanisms in the system 400, for example, the temperature sensor 440, the temperature feedback system 452, the frequency feedback control system 462, the cooling jacket system 454, the processor 458 and the memory 460. The data acquisition system may collect and store data from the various components in the system 400 during operation. The data may be utilized to measure results of EMAT mixing, to configure system components for operation or to determine how the system 400 operates, for example.

Figure 5:
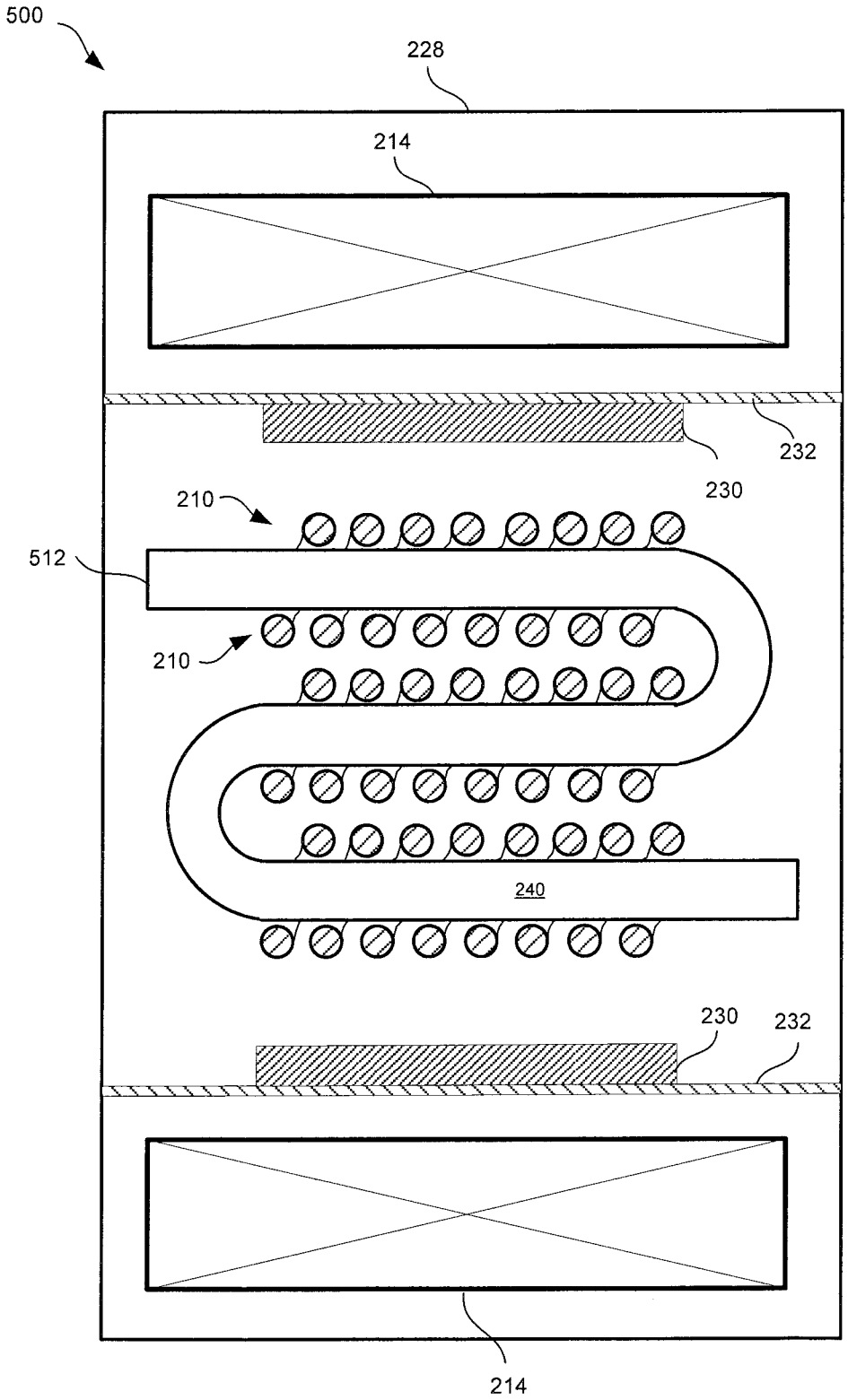
FIG. 5 illustrates a partial sectional view of an electromagnetic acoustic transduction material mixing system including a folded liquid path within a magnet bore that may allow an efficient use of bore volume.

FIG. 5 illustrates a partial sectional view of an electromagnetic acoustic transduction material mixing system including a folded liquid path within a magnet bore that may allow an efficient use of bore volume. The system 500 shown in FIG. 5 may include the cryogenic system 228, the super conducting magnet 214, one or more of the primary induction coil 210, the actively cooled conductive lining 232, the ceramic spacers 230 and the sample 240 which are described with respect to FIGS. 1, 2, 3 and 4. In addition, the system may comprise a folded chamber 512.

The system 500 may be adapted for more efficient use of the magnet 214 and the magnet 214 bore volume. In this regard, the folded chamber 512 may lengthen the liquid path in a continuous EMAT mixing system. Although FIG. 5 comprises a chamber 512 with two folds, the system is not limited in this regard and as many turns or folds may be utilized as may fit and function suitably within the bore area. The configuration of the folded chamber 412 may be determined such that solenoidal induction coils 210 do not destructively interfere. Other induction coil geometries are also possible including poloidal winding, for example.

Figure 6:
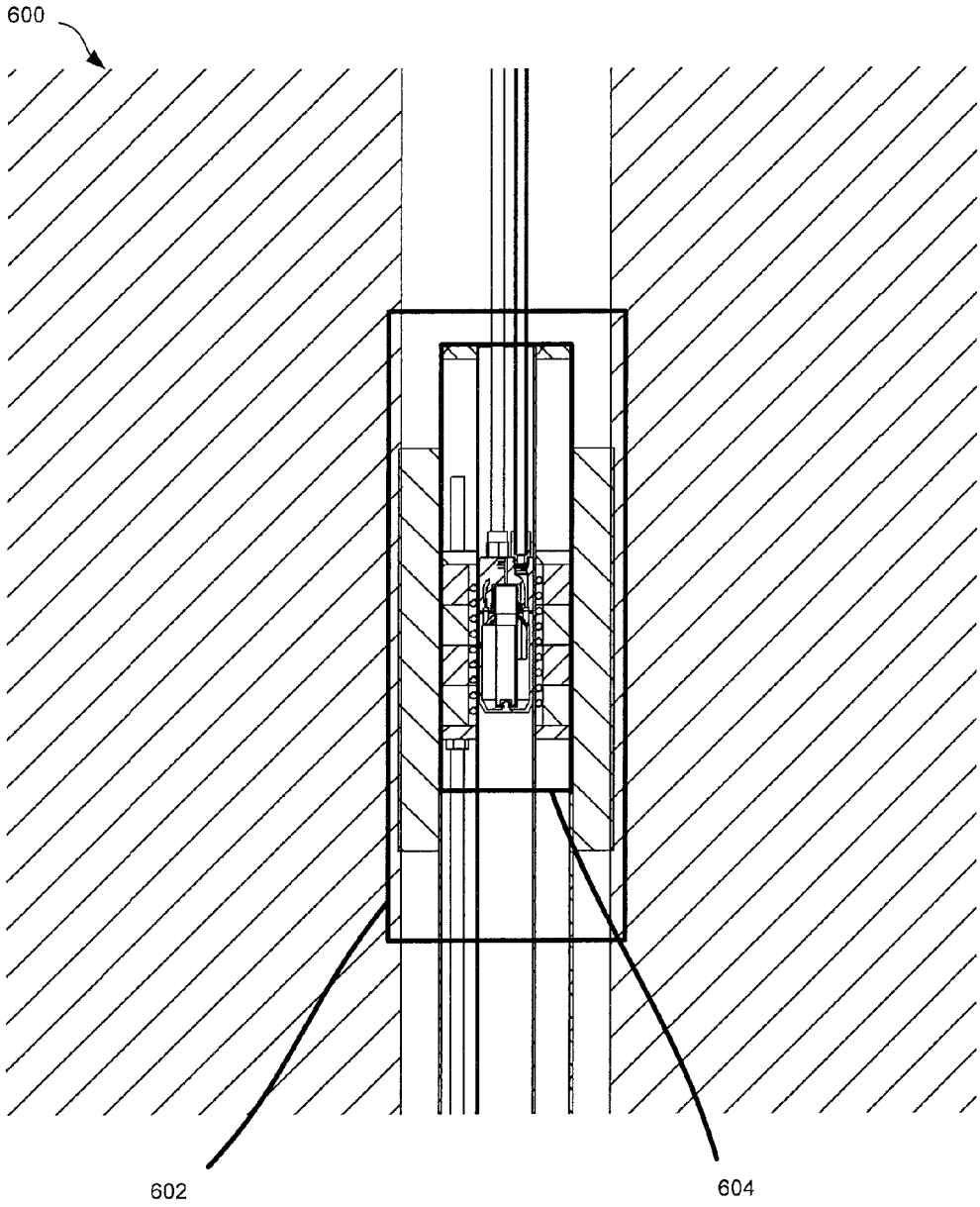
FIG. 6 illustrates a sectional view of a fabricated magnet insert that may be utilized in batch processing in an electromagnetic acoustic transduction particle dispersion system.

FIG. 6 illustrates a sectional view of a fabricated magnet insert that may be utilized in batch processing in an electromagnetic acoustic transduction particle dispersion system. For example, the fabricated magnet insert may be utilized in a system similar to the system 300.

Figure 7:
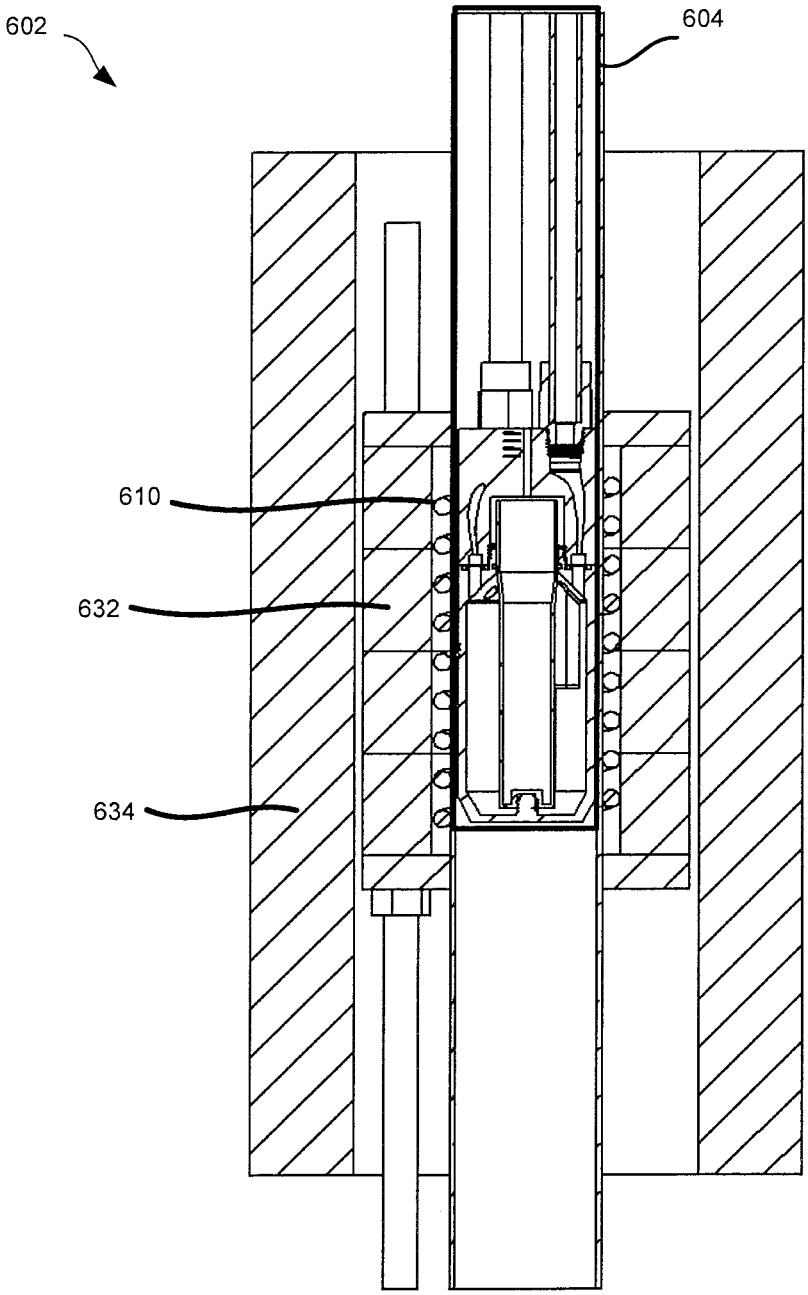
FIG. 7 illustrates a sectional view of the fabricated magnet insert of FIG. 6, including details of an induction coil insert that may be utilized in batch processing in an electromagnetic acoustic transduction particle dispersion system.

FIG. 7 illustrates a sectional view of the fabricated magnet insert of FIG. 6, including details of an induction coil insert that may be utilized in batch processing in an electromagnetic acoustic transduction particle dispersion system.

Figure 8:
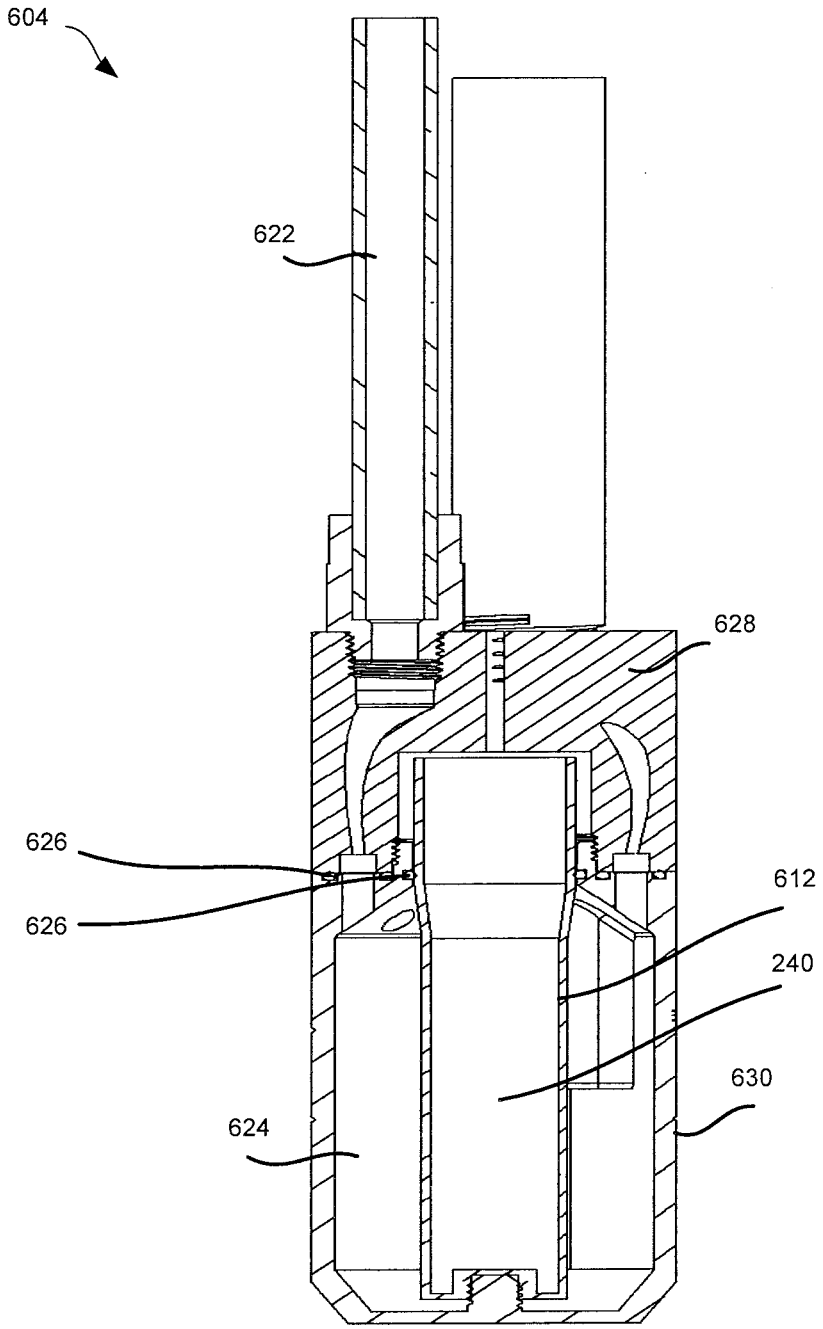
FIG. 8 illustrates a sectional view of the fabricated magnet insert of FIG. 7, including details of a chamber insert that may be utilized in batch processing in an electromagnetic acoustic transduction particle dispersion system.

FIG. 8 illustrates a sectional view of the fabricated magnet insert of FIGS. 6 and 7, including details of a chamber insert that may be utilized in batch processing in an electromagnetic acoustic transduction particle dispersion system.

Referring to FIG. 6, there is shown a high energy magnet 600 may comprise a magnet insert including an induction coil insert 602 and a chamber insert 604. The magnet insert may be sized to fit into the bore of a high energy magnet 600. The induction coil insert 602 may be placed within the bore of the magnet 600 and the chamber insert may be placed within the induction coil insert 602. Referring to FIG. 7, a detail of the induction coil insert 602 is shown. The induction coil insert 602 may house an induction coil 610, thermal insulation 632, acoustic insulation 634 and the chamber insert 604. Referring to FIG. 8, there is shown a detail of the chamber insert 604. The chamber insert 604 may include a crucible 612, a fluid chamber 622, a plurality of seals 626, a fluid chamber 624, a crucible holder 630 and an insert cap 268. In some systems, 3D printing technology may be utilized to build all or a portion of the components of the magnet insert in FIGS. 6, 7 and 8.

The magnet insert shown in FIGS. 6, 7 and 8, including the induction coil insert 602 and the chamber insert 604, and the magnet 600, may function in a similar manner as the system 300, shown in FIG. 3 and/or the system 400 shown in FIG. 4, both of which may include batch processing. In this regard, the induction coil insert 602 and the chamber insert 604 may be inserted into the bore of the magnet 214 which may be a superconducting magnet, to mix contents of a sample using EMAT forces.

The crucible 612 may be filed with the material sample 240 including, at least, a liquid material and particulate matter to be dispersed in the liquid material by electromagnetic acoustic transduction forces. In some instances, a gas space may be included to allow for thermal expansion. A cooling or heating fluid may flow through the channel 622 and fluid chamber 624 to control the temperature of the crucible 612 and the material sample 240 within the crucible 612. The crucible 612 may be isolated by the plurality of seals 626 which may prevent contamination of the material sample 240 by the heater or chiller fluid. The cap 628 and crucible holder 630 may hold the contents of the chamber insert 604 in place during sample 240 processing.

In operation, the inserts 602 and 604 may be utilized in an EMAT particle dispersion system for batch processing. The crucible 612 may be placed coaxially in the chamber insert 604 which may be placed coaxially within the induction coil insert 602. The induction coils 610 may induce an alternating H field that may be directed coaxially with respect to the crucible 612, the induction coil insert 602 and the chamber insert 604. In some systems, the alternating H field may induce a circumferentially directed J current in an outer skin region of the crucible 612. The chamber insert 604 and induction coil insert 602 may be placed coaxially within the bore of the high field magnet 600. The high field magnet may generate a magnetic field B which may be directed coaxially with respect to the crucible and may interact with the circumferentially directed alternating J current. The interaction may result in an alternating radial force that may couple with the sample material 240 in the crucible 612. The particles and liquid in the crucible may be agitated by the alternating radial force which may result in dispersion of the particles in the liquid of the sample 240. In instances when the high field magnet 600 may be a superconducting magnet, the thermal insulation 632 and acoustic insulation 634 of the induction coil insert 602, may protect liquid helium within the bore from flashing and may protect the superconducting magnet from quenching. Various operating parameters may be configured such that the end product of the mixed sample 240 comprises specified properties and/or a specified distribution of the particulate material in the sample. The distribution of the particulate matter in the sample 240 may affect the properties of the final product, for example, flavor or texture of a food product and electrical or thermal resistivity of a product. In this regard parameters such as induction coil frequency, induction coil applied power, B field magnitude, heating or cooling of the sample 240 and/or agents that may be added to the sample may affect the properties of the end product. In some instances, the EMAT force mixing process may enable chemical changes in the sample 240.

Dispersion of particulate material in a base material may be enhanced by application of acoustic energy. One method that has been found particularly effective for conductive materials and non-conductive material is electromagnetic acoustic transduction (EMAT). Acoustic forces generated by induced alternating currents and magnetic fields may be coupled to conductive or non-conductive materials located within co-axial coils. The technical approach may be implemented for continuous and batch processes. The temperature of the base material and particulate matter may be controlled in the EMAT system. Materials heated in EMAT processing may be cooled or heated to control the temperature.

In an exemplary system for processing metal alloys, EMAT processing may be combined with induction heating including high strength and thermal magnetic processing (HTMP) technology. HTMP technology may provide significant improvements in microstructure and material performance. When induction heating is applied in a high magnetic field environment, the induction heating coil 110 may be configured so that high intensity acoustic ultrasonic treatment may occur. The configuration may result in a highly effective electromagnetic acoustical transducer (EMAT). HTMP combined with applying high-field EMAT, may produce a non-contact ultrasonic treatment that may be used to process metal alloys in the liquid state resulting in significant microstructural changes over conventional processing. Proof-of-principle experiments on cast iron resulted in homogeneous microstructures in small castings along with improved casting surface appearance. Wrought-like microstructures were developed in cast components when liquid metal was exposed to non-contact acoustic and ultrasonic processing technology using high magnetic field processing and electromagnetic acoustic transduction.

When induction heating is applied in a high magnetic field 120 environment, the induction heating coil 110 may be configured in such a way that high intensity acoustic ultrasonic treatment may occur naturally. The resulting configuration may be a highly effective electromagnetic acoustical transducer (EMAT). The interaction of the high $J_\theta$ surface current density 118 which may be induced by induction heating, with a steady-state high $B_z$ magnet field 120, may result in an effective method for creating a high energy density acoustic environment. Energy efficiency of the resulting electromagnetic transducer may be improved with the use of the high magnetic field, which may greatly reduce the current needed to achieve the same acoustic pressure. EMAT produced in this way may provide an efficient non-contact method for applying high-intensity acoustic ultrasonic energy to molten and solidified metals. Furthermore, the applied ultrasonic excitation may be uniformly distributed over most of the surface of a metal sample.

Using this high-field EMAT method, non-contacting ultrasonic treatment may be applied to the processing of metal alloys in either the solid or liquid phase. Molten metals may be contained in non-metallic ceramic crucibles that are readily penetrated by the electromagnetic induction fields. Proof-of-principle experiments have resulted in more homogeneous microstructures in small castings along with improved casting surface appearance. This non-contact acoustic ultrasonic processing technology using a high magnetic field in conjunction with induction heating may improve commercial casting applications with a potential to develop wrought-like microstructures in as-cast components.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. An electromagnetic acoustic transduction (EMAT) system for dispersing particles in a fluid material, the system comprising:

an electrically conductive chamber that is configured to hold a sample as it is mixed by EMAT force, the sample including a first material in a fluid state and a second material that includes particulate matter;

a primary coil wrapped around the chamber, wherein the chamber and the primary coil are coaxial;

a secondary coil comprising a bore of a magnet, wherein the chamber and the primary coil are situated within the secondary coil in the bore of the magnet and the secondary coil is coaxial with at least a portion of the chamber and a corresponding portion of the primary coil;

wherein the primary coil, the secondary coil and the electrically conductive chamber generate the EMAT force that spatially disperses the second material in at least a portion of the first material until a spatial distribution of the second material in the at least a portion of the first material enables a quality of the sample to meet specified criteria.

2. The system of claim 1, wherein the first material comprises one or more substances and the second material comprises one or more substances.

3. The system of claim 1, wherein the electromagnetic acoustic transduction force is generated by driving the primary coil with an applied alternating current and inducing by the secondary coil a magnetic field with a magnitude of at least 1 Tesla, the magnetic field induced by the secondary coil being coaxial with at least the portion of the chamber and the corresponding portion of the primary coil.

4. The system of claim 3, wherein the magnetic field with a magnitude of at least one Tesla is induced by the secondary coil, and one or both of the primary coil and the secondary coil comprise:

a uniform number of turns per unit length;

a varied number of turns per unit length; or a combination of a uniform number of turns per until length and a varied number of turns per unit length.

5. The system of claim 1, wherein the electromagnetic acoustic transduction force is coupled to the sample without physical contact to the sample or to the chamber by another physical object which enables the coupling.

6. The system of claim 1, wherein a batch of the sample is sealed in the chamber for batch processing of the spatially dispersing the second material in at least a portion of the first material utilizing the electromagnetic acoustic transduction force.

7. The system of claim 1, wherein the first material flows into the chamber and the second material is added to the first material as it flows through the chamber for continuously processing of the spatially dispersing the second material in at least a portion of the first material utilizing the electromagnetic acoustic transduction force.

8. The system of claim 1, wherein the primary coil is wrapped around the chamber and the chamber is folded within the secondary coil in the bore of the magnet, wherein the primary coil and the secondary coil are utilized in generating the electromagnetic acoustic transduction force.

9. The system of claim 1, wherein one or both of a frequency of the electromagnetic acoustic transduction force and a temperature of the sample or chamber are automatically controlled utilizing a feedback system.

10. The system of claim 1, wherein one or more insertion units comprising one or both of the chamber and the primary coil configured in a wrapped pattern relative to the chamber, are fabricated using 3-D printing.

11. The system of claim 1, wherein:

the chamber comprises a cylindrical shape and is positioned coaxially inside the primary coil and an alternating current is applied to the primary coil, the applied alternating current induces an alternating magnetic field coaxially directed relative to the primary coil;

the induced alternating magnetic field induces an alternating current density circumferentially directed relative to the chamber wherein a tangent of the induced alternating current density is perpendicular to the coaxially directed alternating magnetic field.

12. The system of claim 11, wherein:

the chamber and the primary coil are positioned coaxially within a coaxially directed static magnetic field induced by the secondary coil, wherein the coaxially directed static magnetic field induced by the secondary coil is higher magnitude than the alternating magnetic field induced by the primary coil;

the induced alternating current density circumferentially directed relative to the chamber interacts with the coaxially directed static magnetic field induced by the secondary coil, which generates an alternating force perpendicular to the coaxially directed static magnetic field and perpendicular to the tangent of the induced alternating current density circumferentially directed relative to the chamber; and the generated alternating force couples to the sample and disperses the first material in the second material.

13. The system of claim 1, wherein the particulate matter goes into solution or remains intact after the spatially dispersing the second material in at least a portion of the first material.

14. The system of claim 1 wherein one or more other stirring methods are utilized to spatially disperse the second material in at least a portion of the first material before or after utilizing the electromagnetic acoustic transduction force to spatially disperse the second material in at least a portion of the first material.

15. The system of claim 1, wherein a master alloy, base metal or base material comprising a concentration of the particulate matter is utilized to deliver the second material to the first material.

16. The system of claim 1, wherein a frequency of the electromagnetic acoustic transduction force is adjusted based on a resonant frequency of a system comprising one or more of the primary coil, the chamber and the sample.

17. The system of claim 1, wherein ultrasonic heating is applied to the sample in combination with the electromagnetic acoustic transduction force to adjust a microstructure of the sample.

18. An electromagnetic acoustic transduction (EMAT) system for dispersing particles in a fluid material, the system comprising:

a chamber that is configured to hold a sample as it is mixed by EMAT force, the sample including a first material in a fluid state and a second material that includes particulate matter, and the chamber in combination with the sample comprising electrically conductive material;

a primary coil wrapped around the chamber, wherein the chamber and the primary coil are coaxial;

a secondary coil comprising a bore of a magnet, wherein the chamber and the primary coil are situated within the secondary coil in the bore of the magnet and the secondary coil is coaxial with at least a portion of the chamber and a corresponding portion of the primary coil;

wherein the primary coil, the secondary coil and the electrically conductive material of the chamber in combination with the sample, generate the EMAT force that spatially disperses the second material in at least a portion of the first material until a spatial distribution of the second material in the at least a portion of the first material enables a quality of the sample to meet a specified criteria.

* * * * *